US007771169B2

(12) United States Patent
Kikuchi et al.

(10) Patent No.: US 7,771,169 B2
(45) Date of Patent: Aug. 10, 2010

(54) CENTRIFUGAL MULTIBLADE FAN

(75) Inventors: Hitoshi Kikuchi, Tokyo (JP); Kazuki Okamoto, Tokyo (JP); Shoji Yamada, Tokyo (JP); Yasuyoshi Makino, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 591 days.

(21) Appl. No.: 11/665,258

(22) PCT Filed: May 30, 2006

(86) PCT No.: PCT/JP2006/310730

§ 371 (c)(1),
(2), (4) Date: Apr. 12, 2007

(87) PCT Pub. No.: WO2007/138673

PCT Pub. Date: Dec. 6, 2007

(65) Prior Publication Data

US 2009/0028713 A1 Jan. 29, 2009

(51) Int. Cl.
*F01D 5/14* (2006.01)

(52) U.S. Cl. ..... 416/178; 416/187; 416/223 B; 415/206

(58) Field of Classification Search ..... 415/119, 415/206, 204, 53.1; 416/223 B, 178, 228, 416/248, 175, 203, 187, 186 R, 235, 237
See application file for complete search history.

(56) References Cited

U.S. PATENT DOCUMENTS 4,641,262 A 2/1987 Bryan et al.
2007/0253834 A1 * 11/2007 Ogino et al. ..... 417/71

FOREIGN PATENT DOCUMENTS

| | | | |
|---|---|---|---|
| JP | 60-156997 A | | 8/1985 |
| JP | 2001-23488 A | | 8/2001 |
| JP | 2002-115694 A | | 4/2002 |
| JP | 2003-035294 A | | 2/2003 |
| JP | 2006-077723 A | | 3/2006 |
| JP | 2006077723 A | * | 3/2006 |
| WO | WO 2005-052377 A1 | | 6/2005 |

* cited by examiner

*Primary Examiner*—Richard Edgar
(74) *Attorney, Agent, or Firm*—Buchanan Ingersoll & Rooney PC

(57) ABSTRACT

A plurality of curved rectangular blades are arranged in a circumferential direction on a periphery of a disc, forming a pipe-like basket shape with an opening on a front side of the disc. Rotation of the disc draws in air from the opening and draws out the air in a centrifugal direction through a space between the blades. The blades are formed of a thick plate part close to the disc and a thin plate part that is thinner than the thick plate part and farther than the thick plate part from the disc. A bulge serving as a boundary between the thick plate part and the thin plate part is formed on a negative pressure surface of the blades, which is of curved convex shape.

6 Claims, 4 Drawing Sheets

CENTRIFUGAL MULTIBLADE FAN

TECHNICAL FIELD

The present invention relates to a centrifugal multiblade fan used in an apparatus such as a ventilation apparatus and an air conditioning apparatus.

BACKGROUND ART

A centrifugal multiblade fan includes a plate-shaped disc that has a protruding part at its center with a circular arrangement of a plurality of fan blades fixed at equal intervals to a periphery of the protruding part forming a sort of a pipe shape, each of the blades is thicker around the lifting line at the basal part near the disc and gradually gets thinner as one goes away from the basal part of the disc, to reduce noise and improve wind-blowing efficiency (see, for example, Patent Document 1).

Another conventional centrifugal multiblade fan includes a disc and a plurality of blades, in which each of the blades is circularly arranged about a common rotation axis in almost radial formation. When the fan rotates, a centrifugal airflow is created in a blower. Each of the blades is tapered in such a manner that a chord length towards the disc side, at least at an internal diameter tip becomes longer. The tapered tip has any one of a plurality of cuts, dents, and step-like bulges made at an angle that is suitable for cutting, to suppress separation of an airflow or generation of a turbulent eddy, and reduce noise (see, for example, Patent Document 2).

Patent Document 1: Japanese Patent Laid-Open No. S60-156997 (page 2, FIGS. 5 to 7.)

Patent Document 2: Japanese Patent Laid-Open No. 2001-234888 (Pages 3 and 4, FIGS. 1 to 3).

DISCLOSURE OF INVENTION

Problem to be Solved by the Invention

However, the centrifugal multiblade fan disclosed in the Patent Document 1 has a following problem; a thickness of a blade changes gradually lengthwise and the blade is not configured to create turbulence in the airflow which can restrict the separation of vortex, not leading to enough reduction in noise.

In the centrifugal multiblade fan disclosed in Patent Document 2, when air flows into the cuts, the dents, or the step like bulges on the internal diameter tip of the blades, turbulence in the airflow is generated, which suppresses development of a separation vortex and reduces the noise. In such case, the blades need to have a tapering shape, and common types of blades that do not have the tapering shape are not suitable.

When a blade is changed into a tapered shape, a chord length of a cross section surface of the blade is different at different points lengthwise, compared with a straight blade, wind-blowing features such as wind volume and static pressure also change accordingly. If one wants to have identical wind-blowing features, then one needs to change a power output of a driving motor that leads to a problem of adversely affecting the time required for development and cost.

The present invention is made in consideration of the above problems, and it is an object of the present invention to provide a centrifugal multiblade fan that can reduce the noise without changing the wind-blowing features of the straight blade.

Means for Solving Problem

To solve the above problems, and to achieve the object, a centrifugal multiblade fan according to one aspect of the present invention includes a disc that is rotated by a motor; and a plurality of curved rectangular blades that are arranged in a circular formation on a periphery of the disc, forming a pipe-like basket shape opening on a front side of the disc. Rotation of the disc draws in an air from an opening on the front side of the disc and draws out the air in a centrifugal direction through the blades on the periphery. The blades are formed of a thick plate part close to the disc and a thin plate part that is thinner than the thick plate part and farther than the thick plate part from the disc. A bulge that is the demarcation of the thick plate part and the thin plate part is formed on a negative pressure surface of the blades. The negative pressure surface is of curved convex shape.

Effect of the Invention

According to the present invention it is possible to obtain a centrifugal fan effective in achieving the outcome of suppressing the development of a separation vortex by the local turbulence in the air created by a bulge on the negative pressure surface of the blade, instead of any change in the chord length of the cross section surface of the blade corresponding to lengthwise points on the blade, and also effective in reducing noise without any change in the wind-blowing features.

EXPLANATIONS OF LETTERS OR NUMERALS

Figure 1:
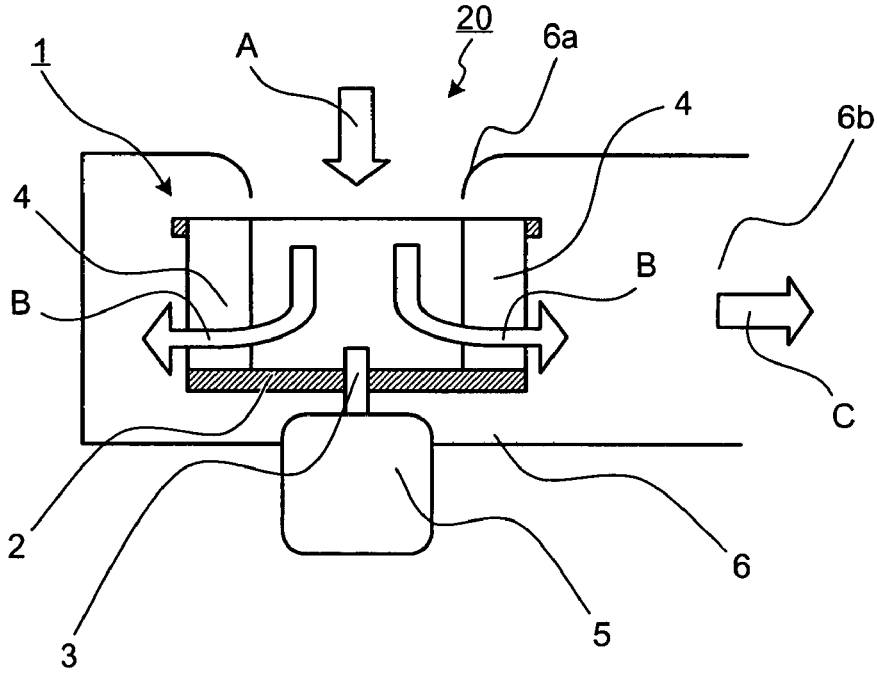
FIG. 1 is a vertical cross-section of a blower equipped with a centrifugal multiblade fan according to the present invention.

1 Centrifugal multiblade fan
2 Disc
3 Rotation axis
5 Motor
6 Scroll casing
6*a* Air inlet
6*b* Air outlet
7 Ring
4 Blade
4*a* Thin plate part
4*b* Thick plate part
8*a* Inner margin part
8*b* Outer margin part
9*a*, 9*b* Negative pressure surface
10 Pressure surface
11 Bulge
20 Blower A, B, C Airflow
D Fan rotation direction
δ' Thickness of thin plate part
Δδ Height of bulge
δ+Δδ Thickness of thick plate part
H Effective length of blade
h Length of thick plate part (distance between bulge and disc)

BEST MODE(S) FOR CARRYING OUT THE INVENTION

Exemplary embodiments of a centrifugal multiblade fan according to the present invention are explained below in detail with reference to the accompanying drawings. The present invention is not to be considered limited to the exemplary embodiments.

Embodiment

Figure 2:
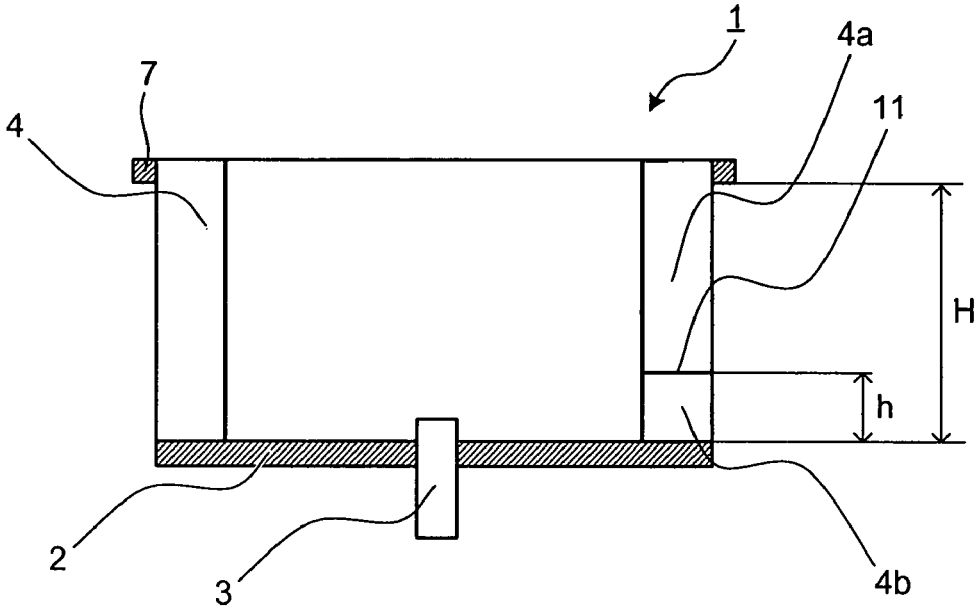
FIG. 2 is a vertical cross-section of a centrifugal multiblade fan according to an embodiment of the present invention.
Figure 3:
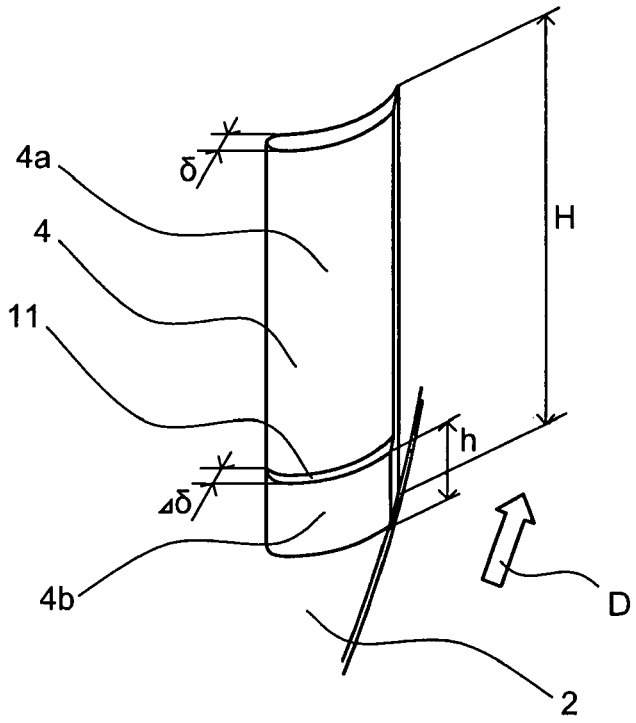
FIG. 3 is a perspective view of a blade of a centrifugal multiblade fan according to the present embodiment of the present invention.
Figure 4:
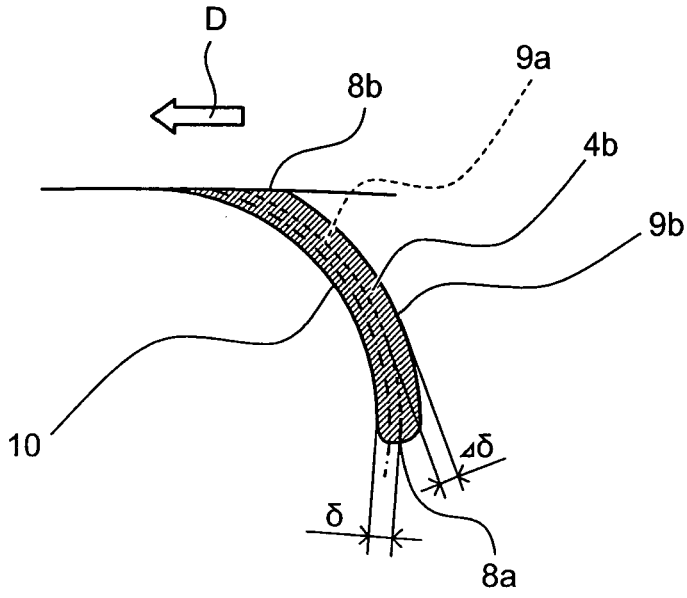
FIG. 4 is a horizontal cross-section of a thick plate part of the blade according to the present embodiment.
Figure 5:
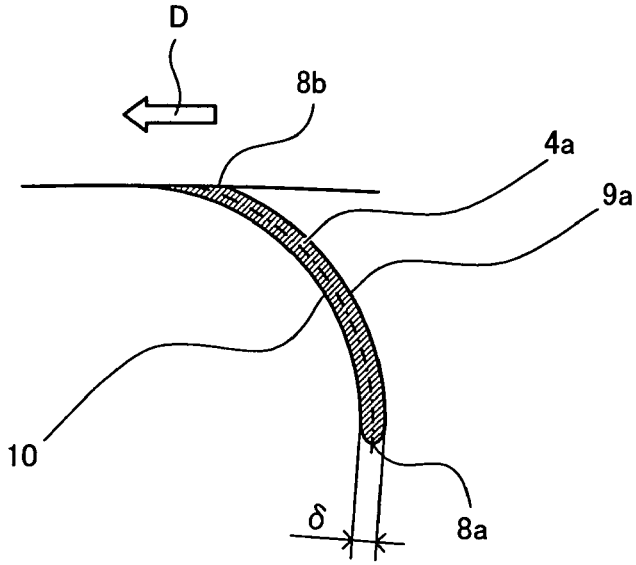
FIG. 5 is a horizontal cross-section of a thin plate part of the blade according to the present embodiment.
Figure 6:
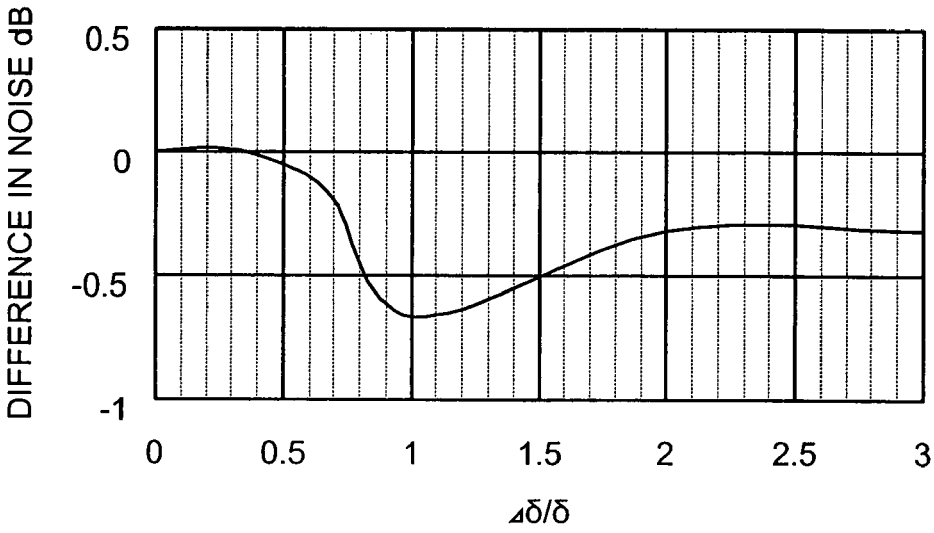
FIG. 6 is a graph explaining the relation between the height of a bulge on the blade and the noise.
Figure 7:
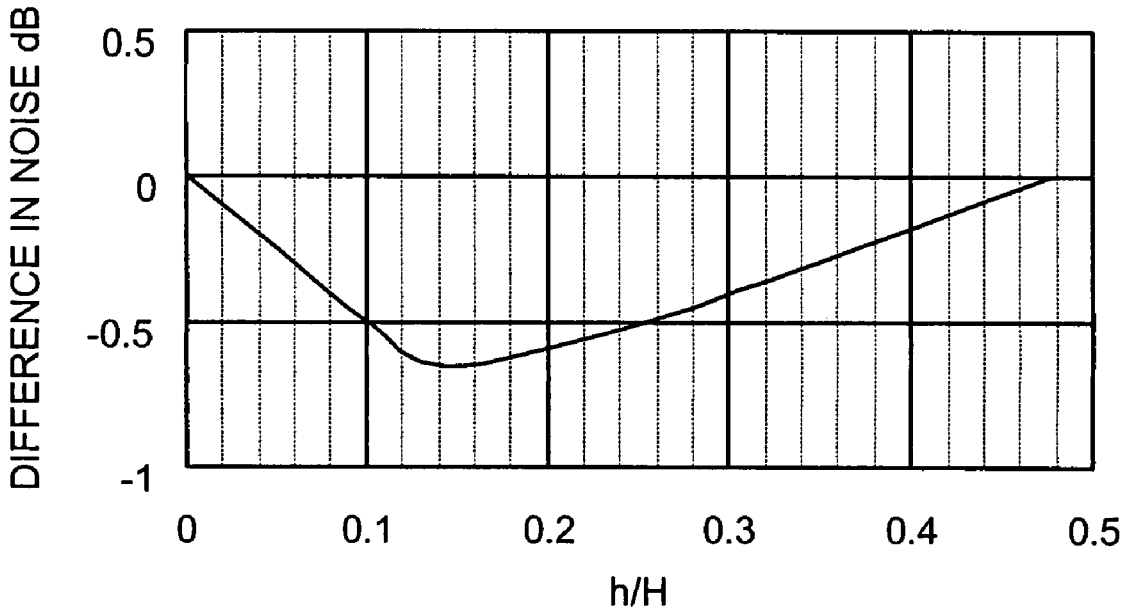
FIG. 7 is a graph explaining the relation between the length of the thick plate part of the blade and the noise.

FIG. 1 is a longitudinal section of a blower equipped with a centrifugal multiblade fan according to the present invention, FIG. 2 is a longitudinal section of a centrifugal multiblade fan according to an embodiment of the present invention, FIG. 3 is a perspective view of a blade of a centrifugal multiblade fan according to the present embodiment of the present invention, FIG. 4 is a cross section of the thick plate part of the blade according to the present embodiment, FIG. 5 is a cross section of a thin plate part of the blade according to the present embodiment, FIG. 6 is a graph explaining the relation between the height of a bulge on the blade and the noise, and FIG. 7 is a graph explaining the relation between the length of the thick plate part of the blade and the noise.

As shown in FIG. 1 a blower 20 according to the present embodiment includes a scroll casing 6 having a round-shaped air-inlet 6*a* at a front side and an air outlet 6*b* located on a periphery, within the scroll casing 6 is a centrifugal multiblade fan 1 attached to the scroll casing 6 facing the air inlet 6*a*, and a motor 5 that rotates the centrifugal multiblade fan 1

As shown in FIGS. 1 and 2, the centrifugal multiblade fan 1 includes a disc 2 that is attached to a rotation axis 3 of the motor 5 and rotated by the rotation axis 3, and a plurality of curved rectangular blades 4 arranged at equal intervals in a circular formation on the periphery of the disc 2 forming a pipe-like basket opening on the front side of the disc 2. An end of a thick plate part 4*b* of each of the blades 4 is fixed to the disc 2. A ring 7 is attached to outer edges of the blades 4, and the tips of the blades 4 are fixed in circular formation at equal intervals with the help of the ring 7.

When the fan 1 is rotated by operating the motor 5, air is drawn in from the air inlet 6*a* of the scroll casing 6, as indicated by an arrow A shown in FIG. 1. The air indrawn from the opening located in front of the disc towards the rotation axis 3 obtains speed and pressure from a pressure surface 10 of the blades 4 of the fan 1 (see FIGS. 4 and 5), is drawn out in a centrifugal direction through the blades 4 on the periphery of the fan 1, is flown into a peripheral duct of the scroll casing 6 as indicated by arrows B, B, and flows out from the air outlet as indicated by arrow C while transforming its kinetic energy into static pressure within the peripheral duct.

At this time, a separation vortex of air is created as the air spreads in a rotation direction of the blades 4 (direction of an arrow D in FIGS. 3, 5) and on an opposite side in an axial direction of the blade along a negative pressure surface 9*a*, 9*b*, causing a broadband noise.

As shown in FIGS. 3 to 5, the blades 4 are formed in a rectangular plate shape of effective length H having inflected at a curvature radius to form a concave shape of the pressure surface 10. An inner margin part 8*a* is of an arc shape with a radius equal to a half of a thickness of the plate, and an outer margin part 8*b* is of an arc shape having a radius identical to a radius of the disc 2.

The blades 4 are made up of the thick plate part 4*b*, having a length h from a point of fixation on the disc and a thickness of δ+Δδ and a thin plate part 4*a* that is away from the disc 2 having a length H-h and a thickness δ. The thickness of the thick plate part 4*b* is made thicker only by Δδ on the negative pressure surface 9*b* as compared to the thin plate part 4*a*, as shown in FIGS. 3 and 4, and convexity of the curve on the negative pressure surface 9*b* forms a bulge 11 and is a demarcation of the thick plate part 4*b* and the thin plate part 4*a*.

Following is an explanation about a usage of the centrifugal multiblade fan 1 configured according to the present embodiment. When the fan 1 is rotated in direction D, the air flows in from the air inlet 6a in the scroll casing 6, as indicated by the arrow A shown in FIG. 1, and flows in axial direction from the opening in the front side of the fan 1. The blades 4 of the fan 1 in rotation provide the speed and the pressure, as indicated by the arrow B, and the air flows out of the air outlet 6*b* from the periphery of the fan 1, as indicated by the arrow C. When the air passes around the bulge 11, a local air turbulence is generated in the airflow around the bulge 11 and the air turbulence restricts the development of the separation vortex, reducing the noise.

The pressure surface 10 of the thick plate part 4*b* and the pressure surface 10 of the thin plate part 4*a* are continuous and have identical configuration and identical chord length which makes a wind-blowing performance of the centrifugal multiblade fan 1 according to the present embodiment identical to a performance of a fan having no bulge and having a (uniform) cross-sectional form over the entire length of the thin plate part 4*a*. As the wind-blowing features such as wind volume and static pressure do not change, there is no need to change the specifications for the motor 5, which is advantageous from a viewpoint of time required for product development and cost. Further, the larger cross section area of the basal part of the blades 4 is effective in strengthening the attachment of the blades 4 to the disc 2.

When a resin injection mold is used to make the centrifugal multiblade fan 1 according to the present embodiment, the cross section of the blades 4 becomes smaller as one goes axially away from the disc 2, which makes it possible to take an axial resin mold die, enabling mass production of the centrifugal multiblade fan using the resin injection mold.

Following is the explanation regarding the inter-relation among a height of the bulge 11 (Δδ/δ), a position of the bulge (h/H) and the noise. If the height Δδ of the bulge 11 is too low then an effect of restriction of the separation vortex is lesser, and if the height Δδ of the bulge 11 is too high then the turbulence in the air generated by the bulge 11 generates noise therefore, an optimum height for reduction in noise is (Δδ/δ).

Taking a ratio Δδ/δ of the thickness δ of the thin plate part 4*a* and the height Δδ of the bulge 11 as a parameter, a noise difference between the blades 4 and a blade having a cross-section all over the entire length identical to the thin plate part 4*a* is shown in FIG. 6. As shown in FIG. 6, if $0.4 \leqq \Delta\delta/\delta$, effective noise reduction is possible, and if $0.8 \leqq \Delta\delta/\delta \leqq 1.5$, substantial noise reduction effect is equal to or more than −0.5 dB.

Because, a flow velocity of the airflow between the blades 4 of the centrifugal multiblade fan 1 is faster at the part closer to the disc 2, there exists an optimum distance h of the bulge 11 from the disc 2 (see FIGS. 2 and 3). A noise difference between the blades 4 and blades having the cross-section over the entire length identical to the thin plate part 4*a* is shown in FIG. 7, taking the ratio h/H between the distance h of the bulge 11 from the disc 2 and the effective length H of the blades 4 as a parameter. As shown in FIG. 7, if $h/H \leqq 0.5$, the noise can be reduced, and if $0.1 \leqq h/H \leqq 0.25$, the noise reduction effect is equal to or more than −0.5 dB.

The thickness of the blades 4 ($\delta$ or $\delta+\Delta\delta$) of the centrifugal multiblade fan 1 explained above according to the present embodiment is uniform from the inner margin part 8*a* and the outer margin part 8*b* but the thickness of the blade need not be uniform.

INDUSTRIAL APPLICABILITY

The centrifugal multiblade fan in the present invention is suitable as a fan in devices such as an exhaust device, air-conditioning device installed in residences, schools, hospitals, offices and the like which require quiet environment.

The invention claimed is:

1. A centrifugal multiblade fan comprising:

a disc that is driven to rotate by a motor; and a plurality of curved rectangular blades arranged in a circumferential direction on a periphery of the disc, forming a pipe-like basket shape with an opening on a front side of the disc, wherein rotation of the disc draws in air from the opening and draws out the air in a centrifugal direction through a space between the blades, the blades are formed of a thick plate part close to the disc and a thin plate part that is thinner than the thick plate part and farther than the thick plate part from the disc, each blade including an inner margin part and an outer margin part, the thick plate part extending with a substantially uniform thickness from the inner margin part to the outer margin part, and a bulge serving as a boundary between the thick plate part and the thin plate part is formed on a negative pressure surface of each of the blades, which is of curved convex shape.

2. The centrifugal multiblade fan according to claim 1, wherein a ratio of a height of the bulge to a thickness of the thin plate part is equal to or larger than 0.4.

3. The centrifugal multiblade fan according to claim 1, wherein a ratio of a height of the bulge to a thickness of the thin plate part is equal to or larger than 0.8 and equal to or smaller than 1.5.

4. The centrifugal multiblade fan according to claim 1, wherein a ratio of a distance from the disc to the bulge to an effective length of the blades is equal to or smaller than 0.5.

5. The centrifugal multiblade fan according to claim 1, wherein a ratio of a distance from the disc to the bulge to an effective length of the blades is equal to or larger than 0.1 and equal to or smaller than 0.25.

6. A centrifugal multiblade fan comprising:

a disc that is driven to rotate by a motor; and a plurality of curved rectangular blades arranged in a circumferential direction on a periphery of the disc, forming a pipe-like basket shape with an opening on a front side of the disc, wherein rotation of the disc draws in air from the opening and draws out the air in a centrifugal direction through a space between the blades, the blades are formed of a thick plate part close to the disc and a thin plate part that is thinner than the thick plate part and farther than the thick plate part from the disc, and a bulge serving as a boundary between the thick plate part and the thin plate part is formed on a negative pressure surface of the blades, which is of curved convex shape, wherein a ratio of distance from the disc to the bulge to an effective length of the blades is equal to or larger than 0.1 and equal to or smaller than 0.25.

* * * * *